United States Patent [19]

Becker et al.

[11] Patent Number: 4,622,625

[45] Date of Patent: Nov. 11, 1986

[54] OPERATING-ROOM LIGHT WITH VARIABLE ILLUMINATION

[75] Inventors: Helmut Becker, Nuremberg; Walter Wohlfart, Kleinostheim, both of Fed. Rep. of Germany

[73] Assignee: W. C. Heraeus GmbH, Hanau, Fed. Rep. of Germany

[21] Appl. No.: 764,922

[22] Filed: Aug. 12, 1985

[30] Foreign Application Priority Data

Sep. 6, 1984 [DE] Fed. Rep. of Germany ..... 3432745

[51] Int. Cl.[4] ..... F21V 7/04

[52] U.S. Cl. ..... 362/304; 362/297; 362/346; 362/804

[58] Field of Search ..... 350/172, 601, 612, 626; 362/297, 346, 804, 304

[56] References Cited

U.S. PATENT DOCUMENTS

| | | | |
|---|---|---|---|
| 1,305,498 | 6/1919 | Schroeder | 362/304 X |
| 3,510,206 | 5/1970 | Smith | 350/601 |
| 4,040,726 | 8/1977 | Paca | 350/601 |

FOREIGN PATENT DOCUMENTS

| | | | |
|---|---|---|---|
| 359178 | 9/1922 | Fed. Rep. of Germany | 350/172 |
| 840290 | 1/1939 | France | 362/304 |
| 302963 | 11/1954 | Switzerland | 350/172 |
| 1537181 | 12/1978 | United Kingdom . | |

*Primary Examiner*—Samuel Scott
*Assistant Examiner*—Allen J. Flanigan
*Attorney, Agent, or Firm*—Frishauf, Holtz, Goodman & Woodward

[57] ABSTRACT

To permit, selectively, illumination of an operating-room field for depth illumination in a path of radiation which may differ from field illumination, a ring-shaped full reflector (3) is located in a reflective position with respect to a light source (1, 2), and, in advance of the main, fully reflective mirror, a mirror system is located which has apertures which can be selectively covered or uncovered with a further mirror element (6, 13, 19) so that the amount of light passing through the apertures of the second mirror system through the first mirror system can be varied, and the path of light controlled in accordance with the relative position of the mirror systems, while the intensity of light reflected by the respective mirror systems is controlled by the positioning of the movable element of the second mirror system with respect to the fixed one.

12 Claims, 4 Drawing Figures

OPERATING-ROOM LIGHT WITH VARIABLE ILLUMINATION

The present invention relates to an operating-room light in which the incidence of the light on an illuminated area can be varied.

BACKGROUND

It has previously been proposed to change the light distribution or light incidence of an illuminated area, particularly of operating-room lights, by providing a fully reflective mirror, in reflective position with respect to a light source and to include, in advance of the fully reflective mirror, a reflector system which has a mirror portion which is partially transmissive and partially reflective. By suitable change of the partially transmissive, partially reflective mirror with respect to the main, or fully reflecting mirror, different distribution of light incident on an illuminated area can be obtained.

British Pat. No. 1,537,181 describes an operating-room light which has a light source from which light beams are directed to two reflectors. The light beams are partially reflected from the first reflector, and partially transmitted; the transmitted portion, then, is directed to a second mirror or reflector. The inclination of the wholly reflecting or main reflecting mirror can be changed with respect to the axis of the originally emitted light beams. The result, as far as the illuminated field is concerned, will be that each one of the mirrors or reflectors will provide separate beam of light; these beams can be individually focussed.

In one such arrangement, eight beams of light are provided, being directed from four different directions on the field to be illuminated. The structure is intended to prevent the formation of heavy shadows. It has been found, however, that the distribution of light, and particularly light which permits illumination of cavities, and provides excellent depth perception, should be improved.

THE INVENTION

It is an object to provide an operating-room light which furnishes essentially uniform illumination in the plane of an operating field, while providing excellent depth illumination, for example of cavities in the body of a patient, or in operating ducts or channels, and which, further, permits variation of the light distribution between flat and depth illumination.

Briefly, a main, or fully reflecting mirror receives light from a light source; a partially reflective, partially transmissive reflector system is provided which, in accordance with the invention, is so arranged that the ratio of light which is reflected and light which is transmitted can be varied.

In accordance with a feature of the invention, the variation can be carried out in steps, or, selectively, continuously.

Preferably, the light processing system is variable in a wide range of from between 3:1 to 1:4.

The light-transmissive portion may be a fixed ring with a mirrored inner surface. The fixed ring is apertured and shiftably located with respect to a coaxial second ring which can be shifted with respect to the fixed ring as a movable reflector element about a ring axis of the fixed ring. Both rings of the reflector system are of part-spherical form. By matching openings of the two rings, a substantial portion of light will be transmitted through the apertures of the rings to the main mirror; the rings can be shifted with respect to each other, preferably continuously, to place the solid mirror surface of the ring behind the apertures in covering or overlapping relationship with respect to the inner apertured ring, thereby continuously varying the light throughput.

In accordance with another embodiment of the invention, which is also highly suitable and, for some applications, is preferred, the movable element includes an additional, fully reflecting mirror with variably positionable mirror surfaces, which is located between the light source and the partially reflecting or fixed mirror.

In accordance with another feature of the invention, the reflector system includes a fixed mirror formed with openings which can be selectively covered or closed by pivotable or tiltable reflector elements, which may have the form of thin plates or sheets or lamellae. The lamella-like or plate-like reflector elements can be pivoted, for example, 90°. This arrangement permits highly variable adjustment, in which the reflector elements can be individually controlled, for example by hand, or by a small motor; it is also possible to control the position of all the reflector elements together. This arrangement permits an essentially continuously variable distribution of the light between the transmitted and reflected radiation.

The system in accordance with the invention has the advantage that the illumination can be changed as required, for example varied for the respective operating steps carried out in advance and during an operation. For example, for preparation of a patient, the illumination may be different from that during an actual operation; the system of the present invention permits optimum matching of the required illumination to the operating procedure to be carried out. A specific advantage is the continuously variable adjustment or an adjustment in very finely subdivided steps of the partially reflecting reflector or mirror, so that the ratio of reflected to transmitted radiation of the partially reflecting mirror permits a practically continuously variable light distribution.

The light source may be one or two lamps, which may be independent of each other. A single lamp with a dual filament may also be used.

DRAWINGS

DETAILED DESCRIPTION

Figure 1:
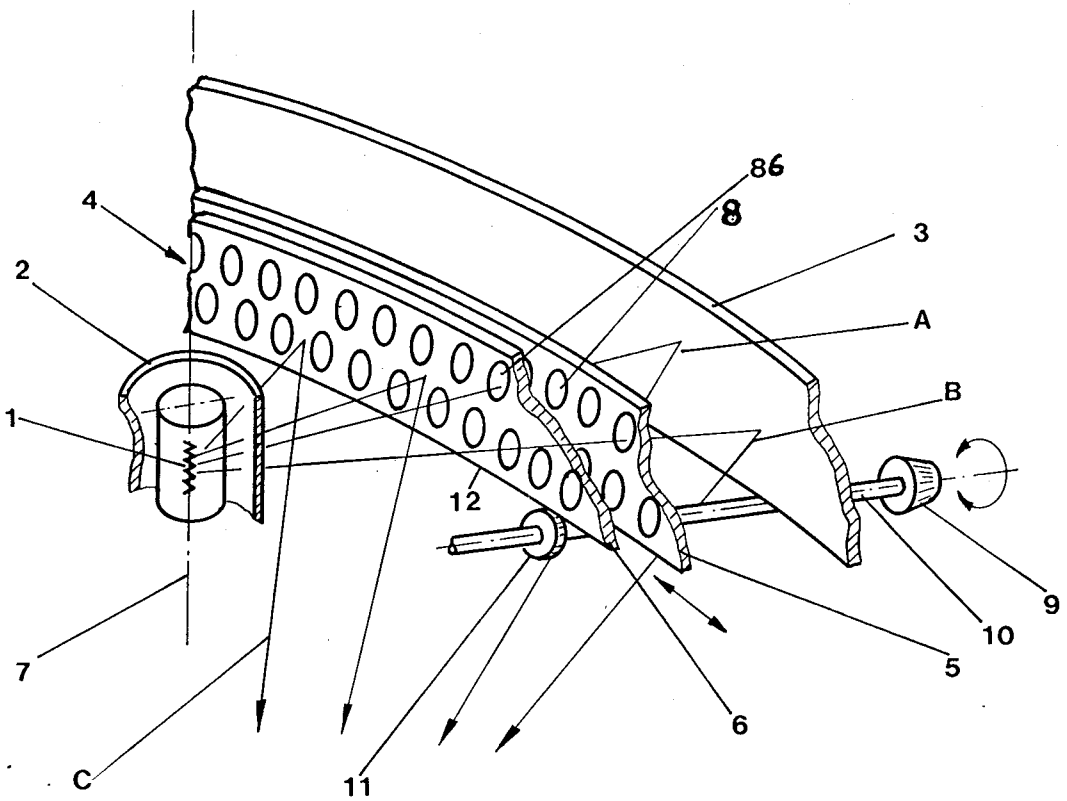
FIG. 1 is a perspective fragmentary view of the operating-room light adjustment system in accordance with one embodiment of the invention, using a two-element apertured diaphragm system.

A light source 1 of conventional type is shielded by a filter 2. Light beams from the light source 1 pass through a partially reflecting reflector system 4, formed of a plurality of components, to a fully reflecting, ring-shaped main mirror 3 which may be constructed in accordance with any suitable arrangement, well known in this field. The reflector system 4 includes a fixed ring-shaped reflector element 5 which is formed at its inner side with a mirrored or highly reflecting surface. The reflector element 5 is apertured and has a plurality of openings 8 therein. The openings 8 are located in the path of the beams of light from the light source 1 to the main, fully reflective mirror 3.

In accordance with a feature of the invention, the reflector system 4 includes a movable reflector element 6, concentric with the reflector ring 5, and rotatably located for rotation about the axis 7 of the ring. The movable reflector element 6 can be so changed with respect to the fixed reflector element 5 that the openings 86 in the movable reflector element are congruent. This permits maximum light radiation to be passed from light source 1 to the main mirror 3. Upon shifting of the reflector element 6 with respect to the reflector element 5, the openings 8 and 86 will no longer match, and will be offset with respect to each other, so that the reflector elements 5, 6, in a limiting position, will form a relatively closed mirrored surface.

An operating element 9 is provided, which permits shifting of the ring 6 with respect to the ring 5, so that, between the extreme positions of full passage of light through the openings 8 and 86, and reflection of light from the solid surfaces between the openings 8 of the mirror 5, the light distribution can be matched to that required at an illuminated surface (not shown). For simplicity, ease of sterilization and cleaning and of operation, the operating element 9 is coupled via a shaft 10 to a gear 11 which engages in a rack 12 formed at the bottom of the movable element 6.

Operation, and paths of light:

Light beams are shown schematically in FIG. 1, and labeled with letters. The light beam A passes from light source 1 through filter 2, opening 86 of the movable reflector element 6 and through the second opening 8 in the fixed reflector element 5 to the main reflective mirror 3. The main reflective mirror 3 is a part-conical or frusto-conical mirror and directs the beam downwardly towards an illuminated field, for example an operating field. The mirror 3 may, also, be curved or part-spherical.

Light beam B, emitted from the light source and after having passed through the filter 2, is also used to illuminate the overall operating field, passing to the main mirror 3 in the same manner as light beam A. Another light beam, shown in the example as light beam C, is directed to the reflective inner surface of the reflective element 6 and is reflected at a much steeper angle than the light beams A, B, to provide depth illumination. Reflector elements 5, 6 may, also, be of frusto-conical form, or part-spherical.

It is possible to make the reflector elements 5, 6 as well as the reflector element 3, of different shapes, for example part-parabolic, or of other suitably curved surfaces, as needed. The form of the reflector elements can be modified and matched to the required need and combination of different reflector shapes—conical, spherical, parabolic, or otherwise curved arrangements—may be used, selectively, for the mirror 3 and/or the mirror system 4.

The ratio of light transmissivity to reflection of the partially reflective, partially transmissive system 4 is about 1:3. This means that 75% of the light beams are directed at a steep angle for depth illumination (light beam C), whereas the openings 8 and 86 pass only about 25% of the light emitted from the source, and reaching the fully reflective main mirror 3 for general area illumination.

Various changes in the arrangement may be made; for example, the respective reflector elements 5, 6 may be formed with openings of square, rectangular or hexagonal configuration, so that the reflector elements 5, 6 will be essentially grid-like. Congruence and shifting of openings can then be obtained, for example, similarly to shifting of a checker-board pattern with respect to another, so that, upon congruence of the openings, half of the illumination is reflected by the system 4 and half is passed for reflection by the main mirror 3. This arrangement, then, permits variation in light between flat area illumination from mirror 3 and depth illumination of between 50% and 100% of the light available from source 1.

Figure 2:
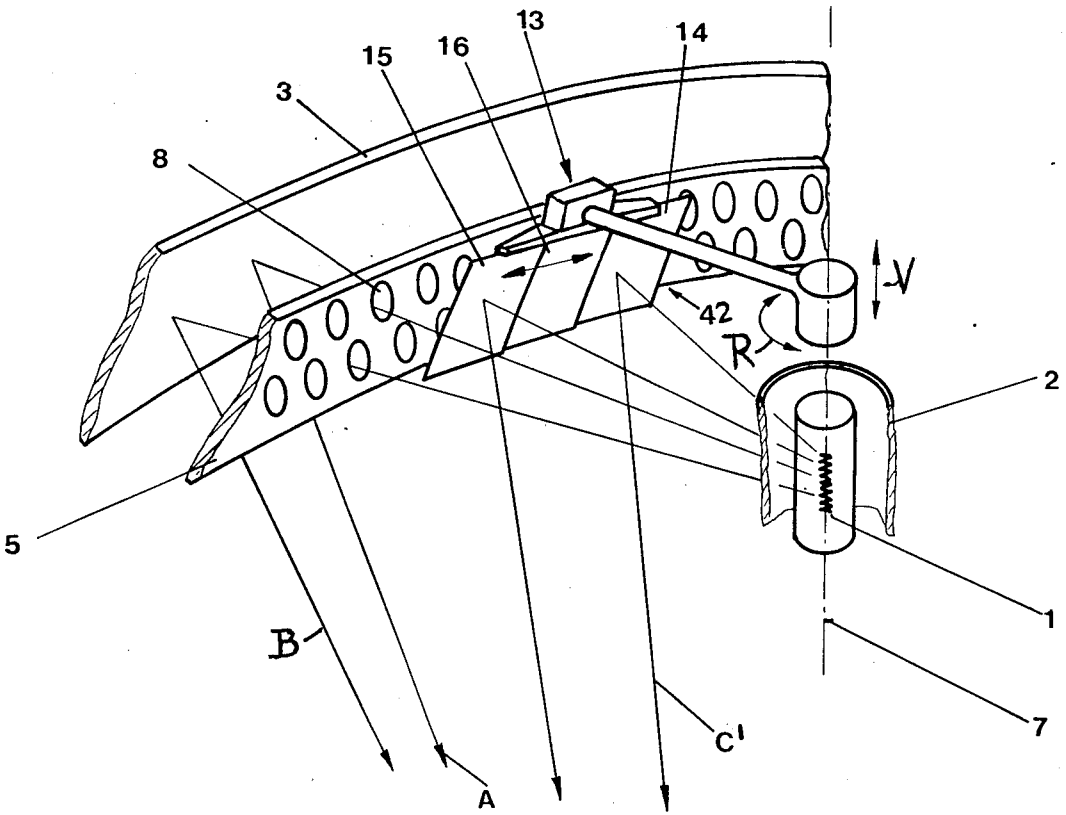
FIG. 2 is a fragmentary perspective view of a system illustrating another embodiment, with an additional reflector in advance of an apertured reflecting surface.

Embodiment of FIG. 2:

The partially reflective mirror system 42 is formed of a ring-shaped fixed reflector element 5, similar to FIG. 1, and, further, includes a fully reflective mirror element 13 which is rotatable about the central axis 7 of the ring of the apertured reflector 5, as schematically indicated by rotation arrow R. In addition, the mirror 13 can be adjusted axially in the direction of the axis 7, that is, vertically, as schematically indicated by the vertical adjustment double arrow V. This arrangement permits change of the reflection to transmission also by axial adjustment—arrow V. The segmental movable reflector element 13 permits asymmetrical illumination of the operating-room field, so that the operating area can be illuminated, for example, starkly in relief, and providing excellent depth perception.

The reflective surface, that is, the coverage of the movable element 13, can also be made changeable, for example by relatively shifting the outer reflector surfaces 14, 15 with respect to a central reflector surface, such that, for example, in a limiting or extreme case, the outer reflector surfaces 14, 15 will be congruent with the central reflector surface 16. In such an arrangement, the maximum amount of light radiation will be passed to the fully reflecting mirror 3—see light beams A of FIG. 2. FIG. 2 also shows the light beams C', reflected by the element 13.

Figure 3:
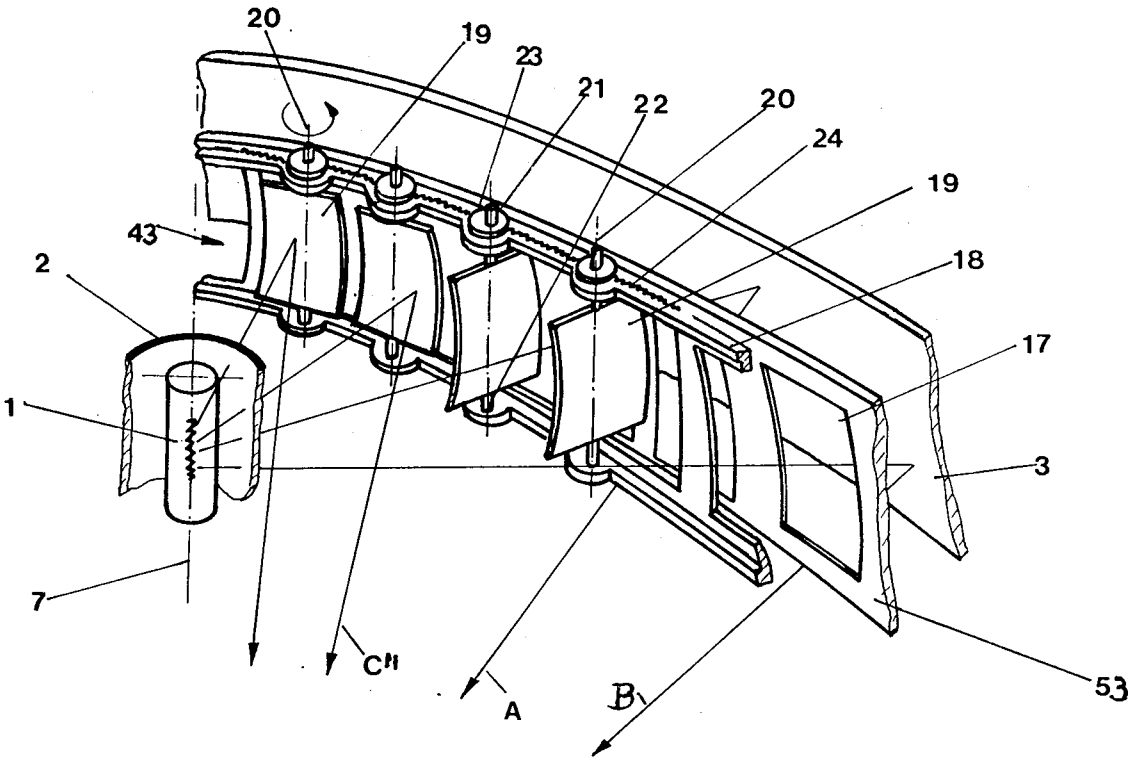
FIG. 3 is a fragmentary perspective diagram illustrating pivotable or tiltable reflector elements.

FIG. 3 illustrates another arrangement, in which the partially reflective system 43 is formed by a ring 53, inwardly of the main, fully reflecting mirror 3. The ring 53 is formed with large, rectangular apertures 17. A ring 18 is located radially inwardly of ring 53 which has rotatably fitted lamella-like reflector elements 19 thereon, located for partially blocking light through the openings 17. The surfaces of the reflecting elements 19 can be rotated or twisted to be either at right angles with respect to the axis 7, that is, extending radially, or facing the light source 1. For maximum light transmission, the elements 19 are positioned radially. A drive apparatus permits rotation of the reflector elements about a vertical axis of 90%, so that theoretical extensions of the reflector elements 19 would intersect the axis 7. The radiation from light source 1 can then pass directly through the rectangular openings 17 to the fully reflective main mirror 1, see light beams A and B. The light reflected from reflector element 53 will be a minimum. If the elements 19 are rotated in the position shown at the last two elements at the left side—with respect to FIG. 3—so that the openings 17 are completely blocked, the entire light emitted from source 1 is used for depth illumination—see light beam C''.

A suitable adjustment arrangement is provided to, for example, adjust individual reflector elements 19 at selected twisted positions, or, for example, adjust all the reflector elements 19 simultaneously. For adjustment, the reflector elements 19 have stub shafts 21, 22 attached thereto, extending about the axis of rotation 20 of the reflector elements 19. At least one of the stub shafts 21, 22 has a pinion 23 attached thereto which engages a gear belt 24 or a similar circular adjustment element, for example a slidable rack, which thereby permits adjustments of all the reflector elements 19 simultaneously. This adjustment can be obtained, for example, by an electrically driven motor having a shaft with a gear or pinion thereon which engages the gear belt or rack, as shown at 24. It is, of course, also possible to provide individual drives for the reflector elements 19 or for a group thereof, for example in order to obtain asymmetrical depth illumination. In such arrangements, each, or a group of reflector elements 19, can be coupled to an electric drive motor, for example by attachment of one or the other of the stub shafts 21, 22 to a miniature motor, permitting individual adjustment, and hence selective illumination of the illuminated field.

Alternating opening and closing of separate reflector elements permits light distribution which is, effectively, continuous and, hence, almost stepless. It is possible, of course, to control groups of reflector elements together.

The reflector elements can be adjusted not only about a vertical axis; adjustability about a horizontal axis, likewise, is possible, which permits additional variation in the size of the field to be illuminated, and further variation in the distribution of light on the illuminated field.

The arrangement of FIG. 3 provides for the largest variation between reflected and transmitted light through the system 43. By closing of the lamellae, approximately 100% depth illumination is obtained; if the light elements 19 are all fanned in radial direction, only the holding strips which surround the openings 17 will reflect, so that approximately 80% of light from source 1 will reach the main mirror 3.

Figure 4:
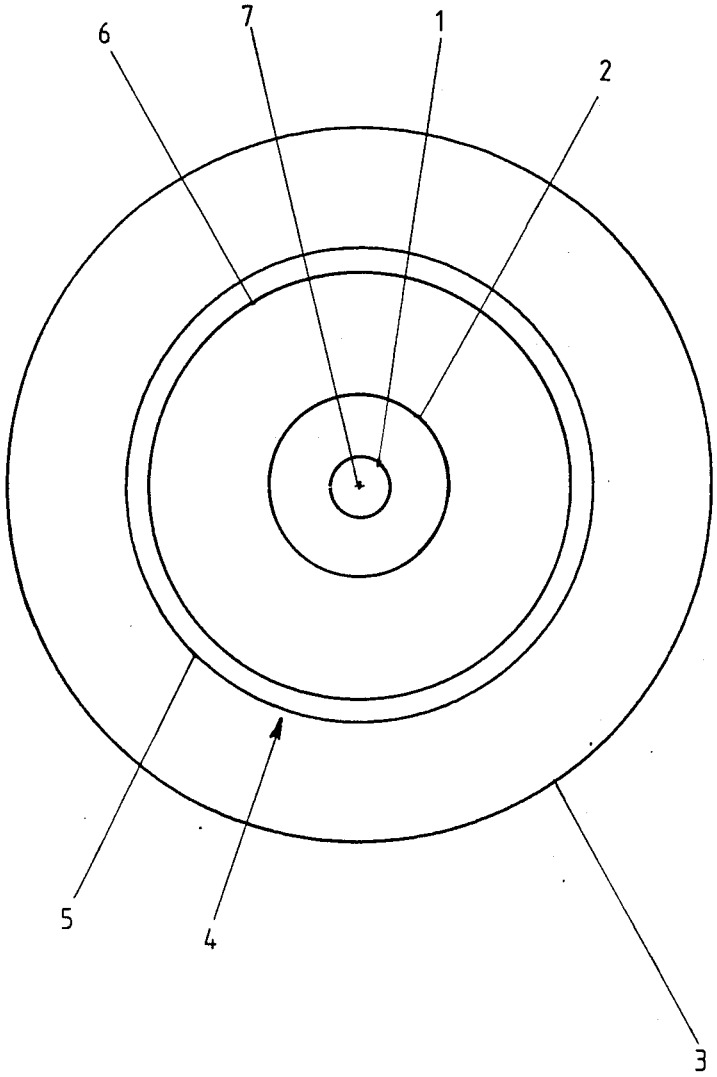
FIG. 4 is a schematic top view of an operating-room light with ring reflectors.

FIG. 4 illustrates, in top plan view, the schematic arrangement of the operating-room light as described, for example, in FIG. 1. The light source 1 is centrally located, surrounded by filter 2, and the fixed fully reflective mirror 3 is located at the outer circumference. The partially reflective, partially transmissive reflector element 5 has the movable reflector element 6 located radially inwardly with respect thereto. The two reflector elements 5, 6, together forming the system 4, may be formed, as desired, and as explained in connection with FIGS. 1–3, for example as shown in FIG. 1. The concentric arrangement shown in FIG. 4 is, of course, equally applicable to the system of FIGS. 2 and 3.

Various changes and modifications may be made, and features described in connection with any one of the embodiments may be used with any of the others, within the scope of the inventive concept.

We claim:

1. Operating-room light having a light source (1);

a first, fully reflective main mirror system (3) located in the path of light from the source and directing light from the source in a predetermined direction (A, B) to provide an illuminated field;

a second mirror system (4, 42, 43) which is partially light transmissive and partially light reflective, said second mirror system being located in the path of light between the source (1) and the first, or main mirror system (3), and directing light from the source in a path (C, C′, C″) which at least partially overlaps the illuminated field, and having means whereby, in accordance with the invention, the ratio of the proportion of light being transmitted with respect to the portion of light being reflected by said second mirror system is adjustable and controllably variable.

2. Apparatus according to claim 1, wherein the ratio between reflected and transmitted radiation is adjustable in a range of from between about 3:1 to 1:4.

3. Apparatus according to claim 1, wherein (FIGS. 1, 2) the second mirror system comprises an apertured reflective mirror (5) and a second mirror element (6, 13), said apertured reflective mirror and said second mirror element being slidable or shiftable with respect to each other.

4. Apparatus according to claim 3, wherein one of: said apertured reflective mirror (5) and said second mirror element (6, 13) comprises one structure which is fixed in position, and another structure which is movable with respect to said fixed structure.

5. Apparatus according to claim 4, wherein the movable structure comprises a fully reflective mirror element located between the light source (1) and the fixed structure (5).

6. Apparatus according to claim 3, wherein the movable element (6) comprises a second apertured reflective mirror (6), having apertures matching the apertures of said first-mentioned apertured reflective mirror (5), said second apertured reflective mirror being shiftable to place the apertures in the respective reflective mirrors (5, 6) in, or, selectively, partially or wholly out of alignment.

7. Apparatus according to claim 1, wherein the second mirror system (43) comprises a fixed reflector element (5) formed with openings (17) therethrough;

and adjustable plate-like reflector elements (19) are provided, positioned for selective covering or uncovering of said openings.

8. Apparatus according to claim 7, wherein said cover elements (19) are essentially rectangular and are formed with oppositely located shaft ends (21, 22) to rotate the elements about an axis in the plane of the plate-like reflective element to align said elements with an edge, or the plane surface of the element facing the light source, and in intermediate positions therebetween.

9. Apparatus according to claim 8, wherein the reflective elements (19) are movable about an axis of 90°.

10. Apparatus according to claim 7, wherein the means for controlling the ratio of light being transmitted with respect to light being reflected by said second mirror system (43) comprises adjustment means coupled to the reflective elements (19).

11. Apparatus according to claim 10, wherein a plurality of openings and a plurality of reflective elements are provided;

and the adjustment means are coupled to at least a predetermined number of said plurality of elements for adjustment of said predetermined number of elements, conjointly.

12. Apparatus according to claim 1, wherein the first, fully reflective mirror system is located in fixed position on said light and comprises a first ring-shaped mirror structure;

and wherein the second mirror system (4, 42, 43) is a second ring-shaped structure, concentric with said first ring-shaped structure forming the first or main reflective mirror system (3) and located radially inwardly with respect thereto, the light source (1) being positioned essentially in the center of said ring-shaped structures;

and wherein the second mirror system (4) comprises one fixed ring-shaped mirror element (5, 53) formed with apertures therein to pass light from the light source through the apertures to the first main mirror system, and movable, reflective means for, selectively, covering, partially covering, or uncovering said apertures, to thereby reflect light, selectively, from the first or main mirror system (3) and, selectively, from the second mirror system in accordance with the respective position of the movable reflective means.

* * * * *